US005593068A

United States Patent [19]

Kitayama et al.

[11] Patent Number: 5,593,068

[45] Date of Patent: Jan. 14, 1997

[54] TONER SUPPLY APPARATUS AND TONER CARTRIDGE THEREFOR

[75] Inventors: Kunihiko Kitayama, Kawasaki; Toshiaki Nagashima, Yokohama; Kiyoshi Oyama, Tokyo, all of Japan

[73] Assignee: Canon Kabushiki Kaisha, Tokyo, Japan

[21] Appl. No.: 265,937

[22] Filed: Jun. 27, 1994

[30] Foreign Application Priority Data

Jun. 25, 1993 [JP] Japan ..... 5-155303

[51] Int. Cl.[6] ..... B65B 1/06; G03G 15/08

[52] U.S. Cl. ..... 222/167; 141/364; 222/325; 222/561; 222/DIG. 1; 399/114

[58] Field of Search ..... 222/160, 167, 222/325–327, DIG. 1, 541, 561, 541.1; 355/260, 245; 141/364

[56] References Cited

U.S. PATENT DOCUMENTS

| | | | |
|---|---|---|---|
| 3,581,949 | 6/1971 | Conrad | 222/167 |
| 3,915,208 | 10/1975 | Anderson | 222/DIG. 1 X |
| 4,441,636 | 4/1984 | Yamashita et al. | 222/DIG. 1 X |
| 4,615,364 | 10/1986 | Kawata | 222/DIG. 1 X |
| 4,752,807 | 6/1988 | Mort | 355/3 DD |
| 4,878,603 | 11/1989 | Ikesue et al. | 222/DIG. 1 X |
| 4,942,432 | 7/1990 | Mort et al. | 222/DIG. 1 X |
| 5,040,024 | 8/1991 | Fukuda et al. | 222/DIG. 1 X |
| 5,074,344 | 12/1991 | Vacek et al. | 222/DIG. 1 X |
| 5,078,303 | 1/1992 | Kikuchi et al. | 222/167 |
| 5,089,854 | 2/1992 | Kaieda et al. | 222/DIG. 1 X |
| 5,261,568 | 11/1993 | Corby et al. | 222/167 |

FOREIGN PATENT DOCUMENTS 0098081 1/1984 European Pat. Off. .

0101303 2/1984 European Pat. Off. .

OTHER PUBLICATIONS

European Search Report dated Nov. 28, 1995.

*Primary Examiner*—Kevin P. Shaver

*Attorney, Agent, or Firm*—Fitzpatrick, Cella, Harper & Scinto

[57] ABSTRACT

A toner cartridge mountable to a cartridge mount of a main assembly of an image forming apparatus comprising an electrostatic latent image bearing member, and a toner container for containing toner for developing an electrostatic latent image on the image bearing member, wherein the cartridge is disposable in a mounting position, where the toner cartridge can be mounted on or dismounted from the cartridge mount, and a toner supply position, where toner can be supplied into the container from the toner cartridge. When toner is to be supplied into the container, the toner cartridge is rotated in a predetermined direction from the mounting position to the supply position, and when the toner cartridge is to be dismounted from the cartridge mount, the toner cartridge is rotated in the opposite direction. The toner cartridge includes a container body for containing the toner, and a toner discharge opening is provided in the container body for discharging toner from the container body. A shutter opens and shuts the discharge opening. A shutter support supports the shutter for movement between a closed position and an open position. A projection located at a corner portion of the support is engageable with an engaging portion of the cartridge mount, wherein when the toner cartridge is at the toner supply position, the projection is engaged with the engaging portion to prevent removal of the toner cartridge from the cartridge mount.

32 Claims, 18 Drawing Sheets

TONER SUPPLY APPARATUS AND TONER CARTRIDGE THEREFOR

FIELD OF THE INVENTION AND RELATED ART

The present invention relates to a toner supply apparatus or a toner cartridge usable therefor in an image forming apparatus such as an electrophotographic apparatus in which an electrostatic latent image formed on an electrostatic latent image bearing member is developed with toner powder.

In either an apparatus using one component developer or an apparatus usable with two component developer, when the amount of toner in a developing unit decreases beyond a predetermined level as a result of developing electrostatic latent images, additional toner is supplied from a toner hopper containing toner into a developing unit. When the amount of the toner in the hopper decreases beyond a predetermined amount, the operator manually supplies toner to the hopper as a toner storage unit. Usually, a toner cartridge is used for the supply operation.

The toner cartridge Is mounted on a cartridge mounting portion of an image forming apparatus, and a toner discharge opening of the toner cartridge is opened to let the toner fall into the hopper. Thereafter, the toner cartridge is removed from the mount.

Among such toner cartridges, there is a type having a shutter for closing and opening the toner discharge opening, manually. In such a toner cartridge, after the toner is supplied to the hopper, the toner discharge opening is closed by the shutter, and the cartridge may be removed from the mount, and therefore, it is convenient because the toner remaining in the cartridge does not scatter.

However, if the cartridge is removed from the mount before completely closing the toner discharge opening with the shutter, there is a drawback is that the toner remaining in the cartridge scatters from the toner discharge opening.

In addition, if the cartridge is not securely mounted to the mount, the toner may scatter from the discharge opening.

SUMMARY OF THE INVENTION

Accordingly, it is a principal object of the present invention to provide a toner cartridge and a toner supply apparatus for receiving toner using the toner cartridge, in which the cartridge can be securely mounted.

It is another object of the present invention to provide a toner cartridge and a toner supply apparatus in which, when the shutter is not in the closed state, the toner cartridge is prevented from being removed from the mount.

It is a further object of the present invention to provide a toner cartridge and a toner supply apparatus in which operativity is improved when toner is supplied to a toner storage unit.

It is a yet further object of the present invention to provide a toner cartridge and a toner supply apparatus in which toner leakage is prevented when the toner is supplied into a toner storage unit.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 18:
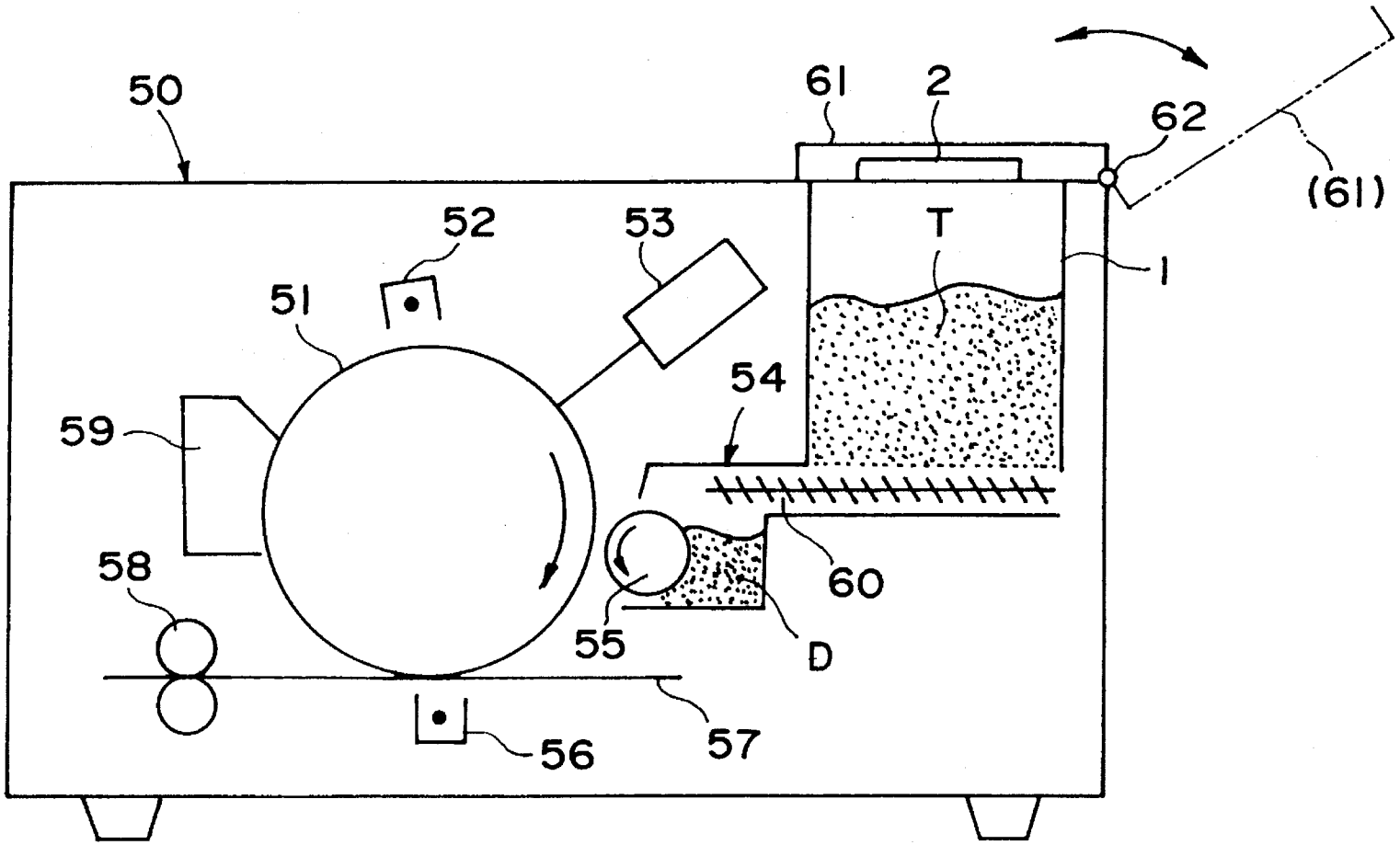
FIG. 18 shows an example of an image forming apparatus usable with the present invention.

FIG. 18 shows an electrophotographic apparatus usable with the present invention.

In FIG. 18, an electrophotographic image forming apparatus 50 comprises an electrophotographic photosensitive member 51 rotatable in a direction indicated by an arrow. The photosensitive member 51 is first charged by a charger 52, and is exposed to image light by exposure device 53, so that an electrostatic latent image is formed thereon.

The electrostatic latent image is developed by a developing limit 54, which comprises a developing roller 55 rotatable in a direction indicated by an arrow. The developing roller 55 carries a developer D to supply it to the electrostatic latent image. The developer may be one component developer, or two component developer. In any event, the toner on the developing roller is deposited onto the electrostatic latent image to form a toner image.

The toner image thus formed is transferred onto a transfer sheet 57 by a transfer charger 56, and the transferred image is fixed on the sheet 57 by a fixing device 58. After the image transfer operation, the photosensitive member 51 is cleaned by a cleaning device 59.

In order to resupply the toner consumed by the developing unit 54, toner T is supplied from a toner storage container (hopper) 1 to the developing unit 54 by a feeding device 60 such as a screw conveyer or the like.

When the remaining amount of the toner T in the container 1 becomes lower than a predetermined level, the operator supplies additional toner into the container 1 from a toner cartridge.

The toner cartridge is mounted to a cartridge mount 2 provided at a top part of a hopper (toner storage container) 1. The toner cartridge mount 2 is usually covered with a cover 61. The cover 61 is rotatably supported on a shaft 62. When the cartridge is to be mounted to the mount 2, cover 61 is manually rotated to a position indicated by a dot, dash line by the operator to expose the mount 2.

Figure 4:
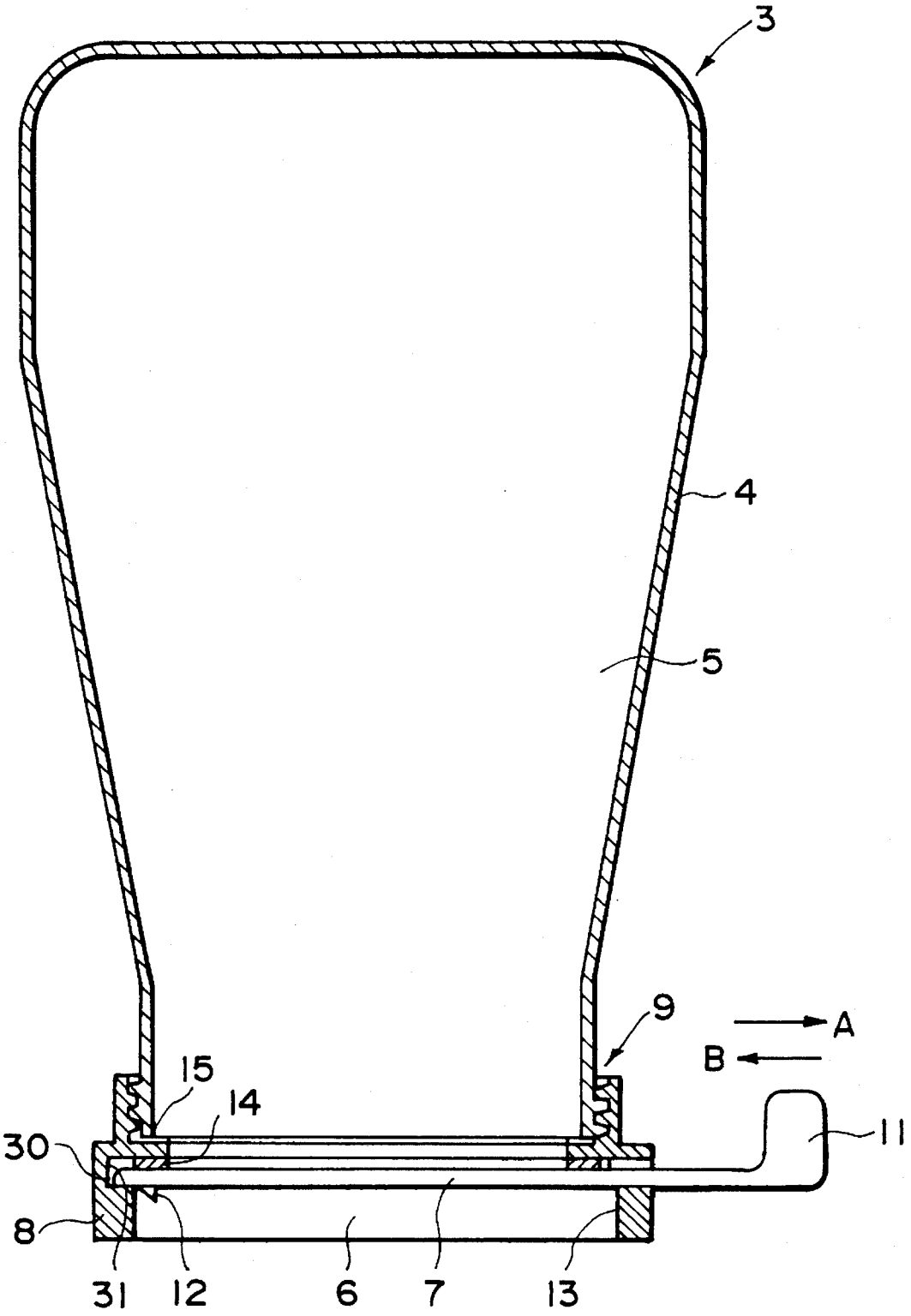
FIG. 4 is a sectional view of a toner cartridge.

FIG. 4 is a sectional view of a toner cartridge.

The toner cartridge 3 comprises a container body 4 having a toner accommodation chamber 5 for accommodating toner to be supplied to the hopper 1, a shutter plate 7 for closing and opening the toner discharge opening 6, and a shutter support 8 for slidably supporting the shutter plate 7.

Figure 7:
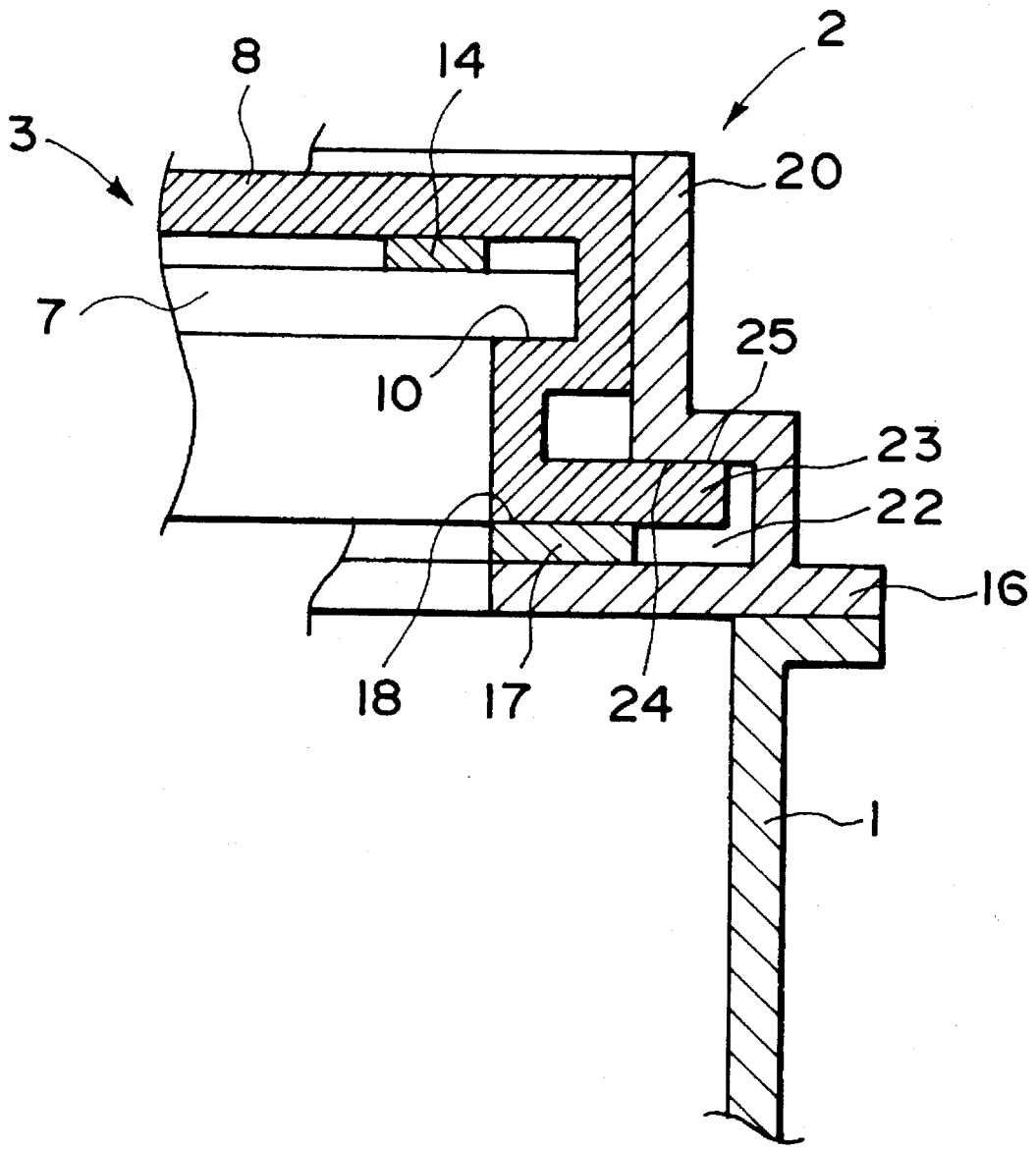
FIG. 7 is a sectional view taken along a line Z—Z in FIG. 2.

The shutter support 8 is securely fixed to the container body 4 by a screw mount 9. The shutter support 8, as shown in FIG. 7, is provided with a shutter guide 10. The shutter plate 7 slides on the guide 10, and is rectilinearly reciprocable in a direction perpendicular to the toner discharge direction (downward) from the toner discharge opening 6.

In this specification, the movement of the shutter plate 7 in the direction to open the opening 6 (arrow A in FIG. 4) is a pulling movement of the shutter plate 7, and the movement of the shutter plate 7 in the direction to close the opening 6 (B in FIG. 4) is called the "pushing movement".

Designated by reference numerals 14 and 15 are elastic sealing members made of rubber, felt or the like to prevent the leakage of toner between the shutter plate 7 and the shutter support 8, and between the container body 4 and the shutter support 8, respectively.

A grip 11 is provided adjacent an end of the shutter plate 7 in the pulling direction, the operator grips the grip 11 to move the shutter plate 7 in directions A and B.

To the rear end of the shutter plate 7 in the pulling direction, there is provided a stopper projection 12. When the shutter plate 7 is completely pulled out to completely open the toner discharge opening 6, the stopper projection 18 abuts a front wall 13 of the shutter support 8 to prevent further motion of the shutter plate 7, thus preventing the shutter plate 7 from being pulled out of the support 8 (see FIG. 6).

Figure 2:
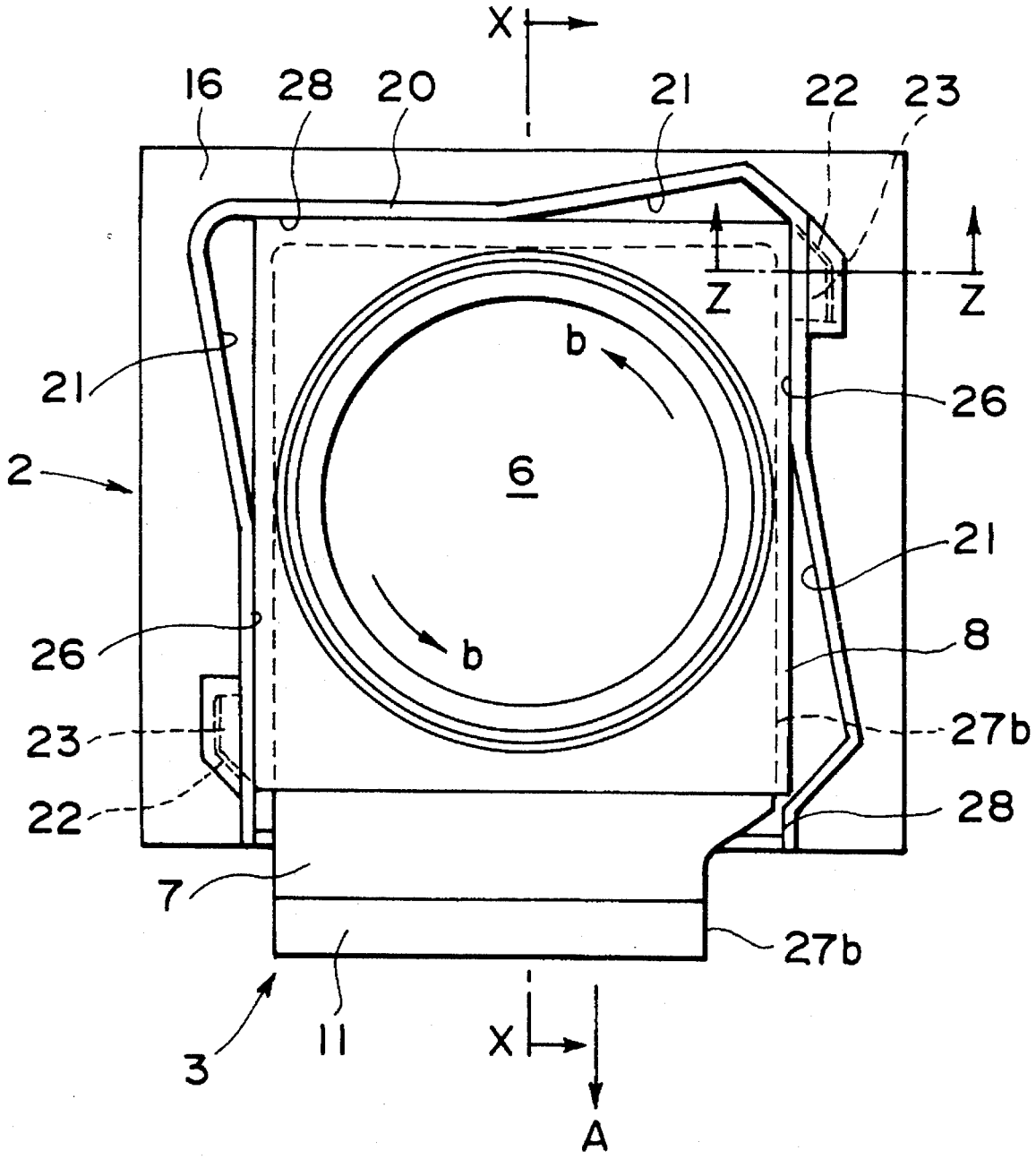
FIG. 2 is a top plan view of the same cartridge when the toner cartridge is in a toner discharge position.
Figure 5:
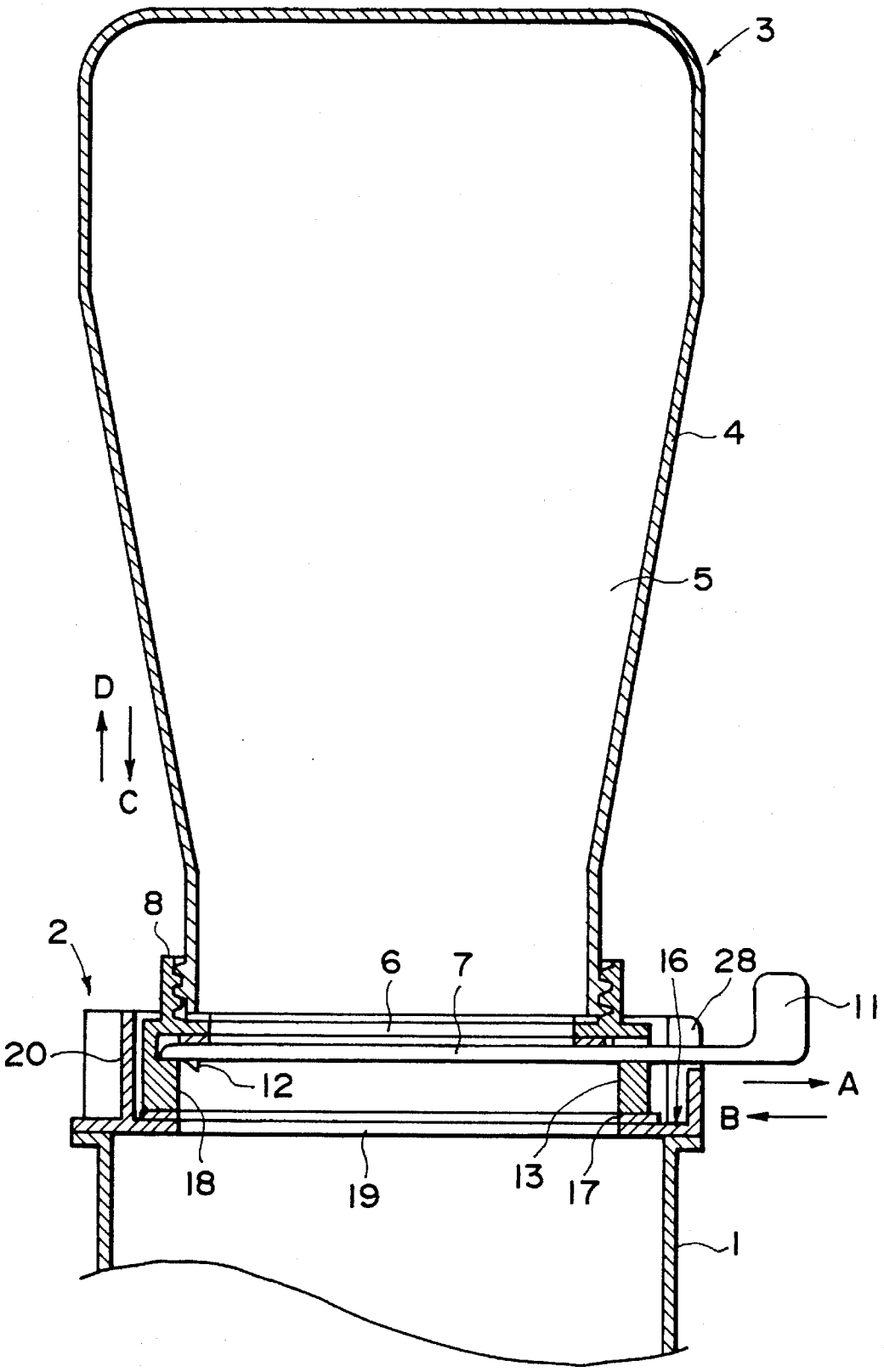
FIG. 5 is a sectional view taken along a line X—X in FIG. 2.

As shown in FIG. 5, which is a cross-section taken along a line X—X of FIG. 2, the cartridge mount 2 comprises a base plate 16 fixed on the top of the hopper 1, and an elastic sealing member 17 made of rubber, felt, synthetic resin material or the like, fixed on the base plate 16. The shutter support 8 of the cartridge 3 is slidably mounted on the top surface 18 of the elastic sealing member 17.

The base plate 18 is provided with a toner receiving opening 19 through which the toner discharged through the toner discharging opening 6 of the toner cartridge 3 falls into the hopper 1.

Figure 1:
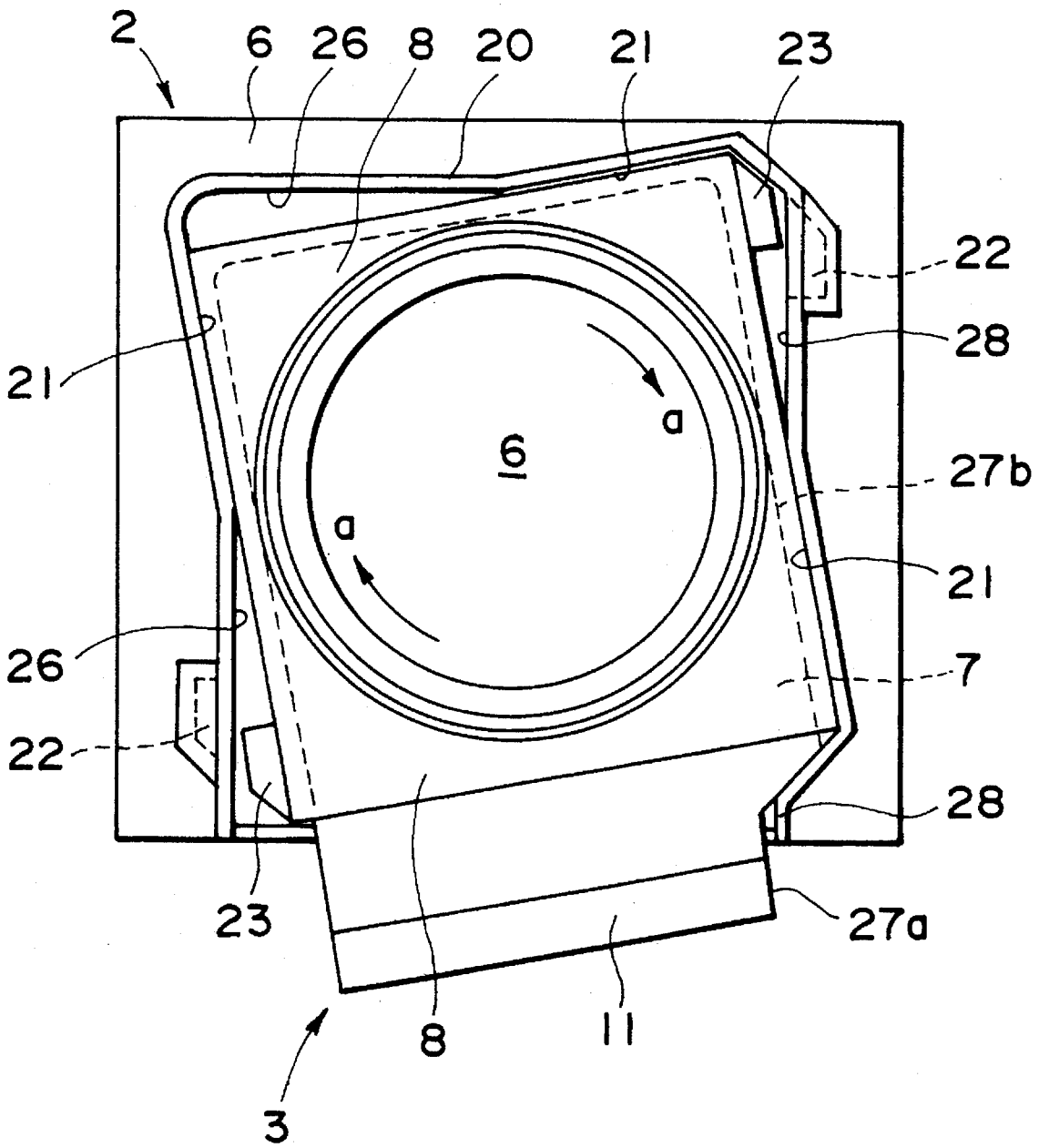
FIG. 1 is a top plan view illustrating a toner cartridge mounted on the mount in a removable position.

A wall plate 20 is fixed on and perpendicularly extends from the base plate 16. The wall plate 20, as shown in FIG. 1, is provided with a guiding surface 21 for guiding the mounting and dismounting of the toner cartridge relative to the cartridge mounting position of the cartridge mount 2. By the sliding motion of the shutter support 8 of the toner cartridge 3 on the guiding surface 21, the motion of the toner cartridge 3 is guided in a direction substantially perpendicular to the cartridge mounting surface 18.

More particularly, the operator holds the container body 4 of the cartridge 3 by hand, and lowers it in a direction C shown in FIG. 5 along the guiding surface 21, by which the cartridge 3 is placed on the surface 18. On the other hand, by raising the cartridge 3 in a direction D along the guiding surface 21, the cartridge 3 is removed from the mount 2.

Figure 3:
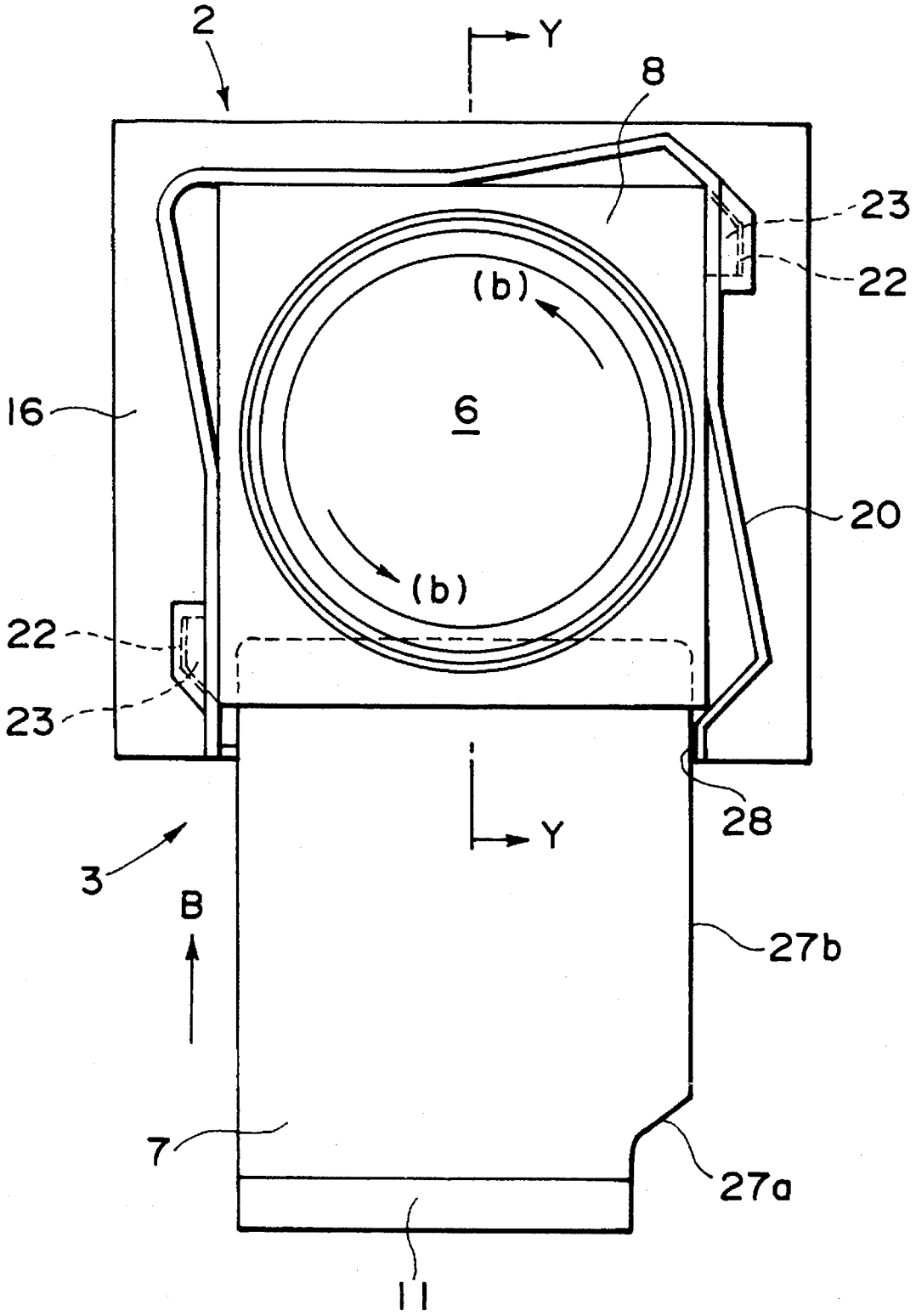
FIG. 3 is a top plan view in which the shutter is in the completely open position while the toner cartridge is in the toner discharge position.

FIGS. 1, 2 and 3 are top plan views of the toner cartridge mounted on the cartridge mount 2.

For the sake of simplicity of explanation, the container body is omitted from the Figures.

In FIG. 1, the toner cartridge has been mounted to the mount 2 and takes a cartridge mounting or dismounting position. In FIG. 1, the toner discharge opening 6 of the cartridge 3 is completely closed by the shutter plate 11.

When the cartridge 3 is mounted in the position shown in FIG. 1, the operator holds the container body 4, for example, and rotates it about an axis substantially perpendicular to the cartridge mounting surface 18, as indicated by an arrow a. At this time, the bottom surface of the shutter support 8 slides on the mounting surface 18.

A projection 23 of the shutter support 8 is engaged into a recess 22 formed in the wall plate 20, by the above rotation (see FIG. 2, and FIG. 7 which is a sectional view taken along a line Z—Z of FIG. 2).

As shown in FIG. 7, the top surface 24 of the projection 23 of the toner cartridge 3 is press-contacted to the top sealing surface 25 of the recess 22, by which the toner cartridge 3 is prevented from being removed upwardly from the cartridge mount 2. FIG. 2 shows the state in which the toner cartridge 3 is in a toner discharge position for discharging the toner into the hopper by opening the toner discharge opening of the toner cartridge 3. By the engagement of the projection 23 of the cartridge into the recess 22 of the mount 2, removal of the toner cartridge 3 from the mount 2 is prevented when the toner cartridge is in the toner discharge position.

Referring again to FIG. 7, by the press-contact between the projection 23 and the sealing surface 25 of the recess 22, the bottom surface of the shutter support 8 of the cartridge elastically compresses the sealing member 17 to improve the press-contact therebetween, so that toner leakage from the contact portion between the cartridge 3 and the mount 2 can be further prevented.

In this embodiment, the projection 23 is formed on the toner cartridge 3, and the recess 22 is formed in the cartridge mount. However, the recess may be formed in the toner cartridge 3, and the projection may be formed in the toner cartridge, wherein they are engaged by rotation of the cartridge 3 in a direction a.

Thus, the toner cartridge 3 is slidingly rotated in a direction a on the mount surface 18, by which the projection 23 is engaged into the recess 22, so that the cartridge 3 takes the toner discharge position as shown in FIG. 2. At this time, three side surfaces of the shutter support 8 of the cartridge 3 are abutted to three stopping surfaces 26 formed on the wall plate 20, respectively. In this manner, further rotation of the toner cartridge in the direction a beyond the toner discharge position, is prohibited.

A second portion of the side surface of the shutter support 8, contactable to the stopper surfaces 26, are different from a first position slidable relative to the guiding surface 21, and as will be understood from FIGS. 1 and 2, when the first portion is in contact with the guiding surface 21, the second portion is disengaged from the stop surfaces 26. On the other hand, when the second portion is in contact with the stopping surface 26, the first portion is out of contact with the guiding surface 21.

When the cartridge 3 is brought into the state shown in FIG. 2, that is, the toner discharging position by the recess 22 and the stopper surface 26, the operator grips the grip 11 of the shutter plate 7, and pulls the shutter plate 7 in a direction A. As will be understood from FIGS. 1 and 2, the shutter plate 7 pulling direction crosses with the rotational direction a of the toner cartridge 3.

Figure 8:
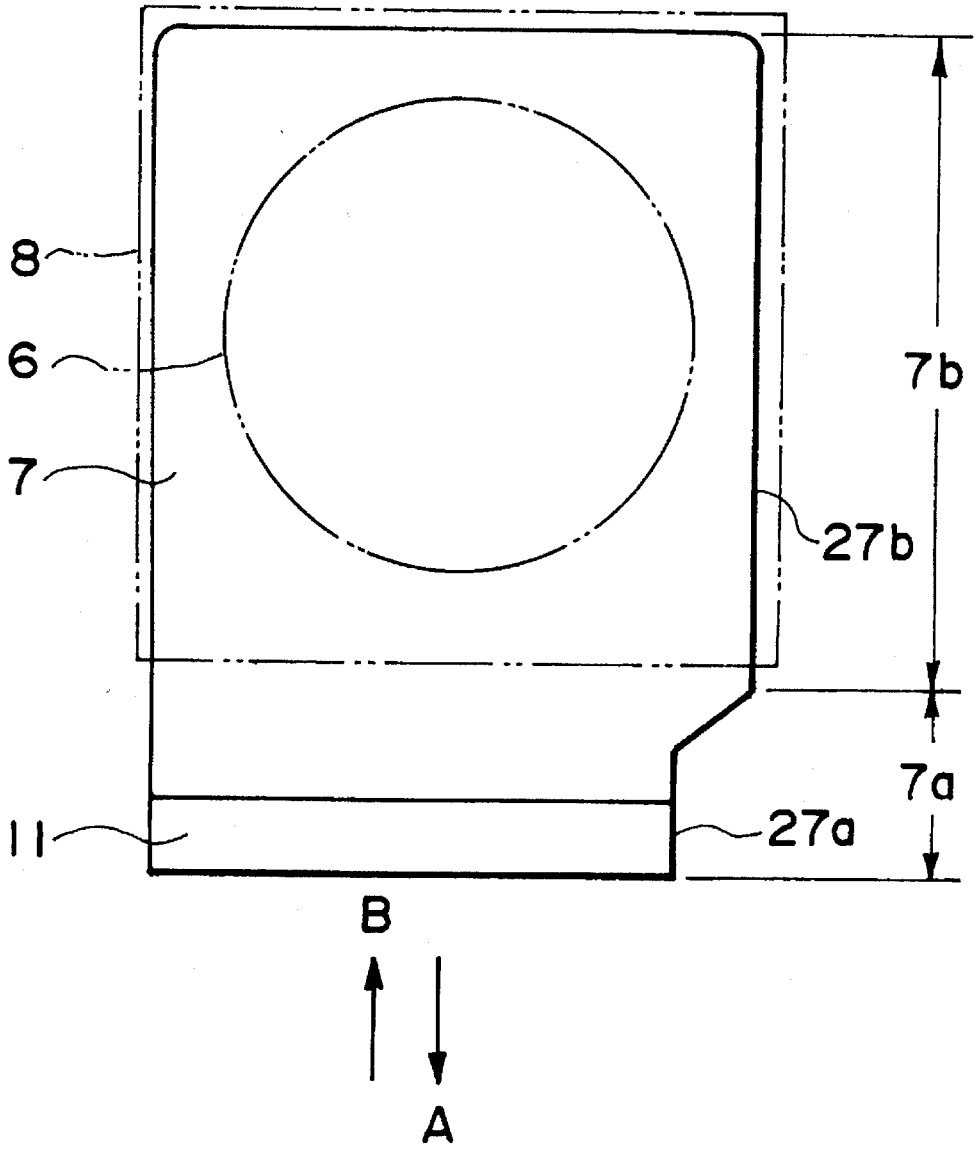
FIG. 8 is a top plan view of a shutter plate.

Referring now to FIG. 8, the shutter plate 7 comprises a narrow portion 7*a* and a wide portion 7*b* having a width larger than that of the narrow portion 7*a*.

The narrow portion 7*a* is disposed at a front side with respect to the pulling direction of the shutter plate 7. Therefore, an end of a front part of the shutter plate 7*a* is cut-away, as shown in FIG. 8.

In FIG. 8, the toner discharge opening 6 of the toner cartridge 3 is completely enclosed by the wide portion 7*b* of the shutter plate 7. The wide portion 7*b* is in slidable engagement with the shutter support 8, and even when the wide portion 8*b* completely closes the shutter discharge opening 6, the narrow portion 7*a* projects out from the shutter support 8.

The narrow portion 7*a* is provided with an inclined stepped portion in the illustrated example, although it may be a stepped portion perpendicular to a side surface 27*b* of the wide portion 7*b*.

The grip 21 is fixed to an end of the narrow portion 7*a*.

Figure 6:
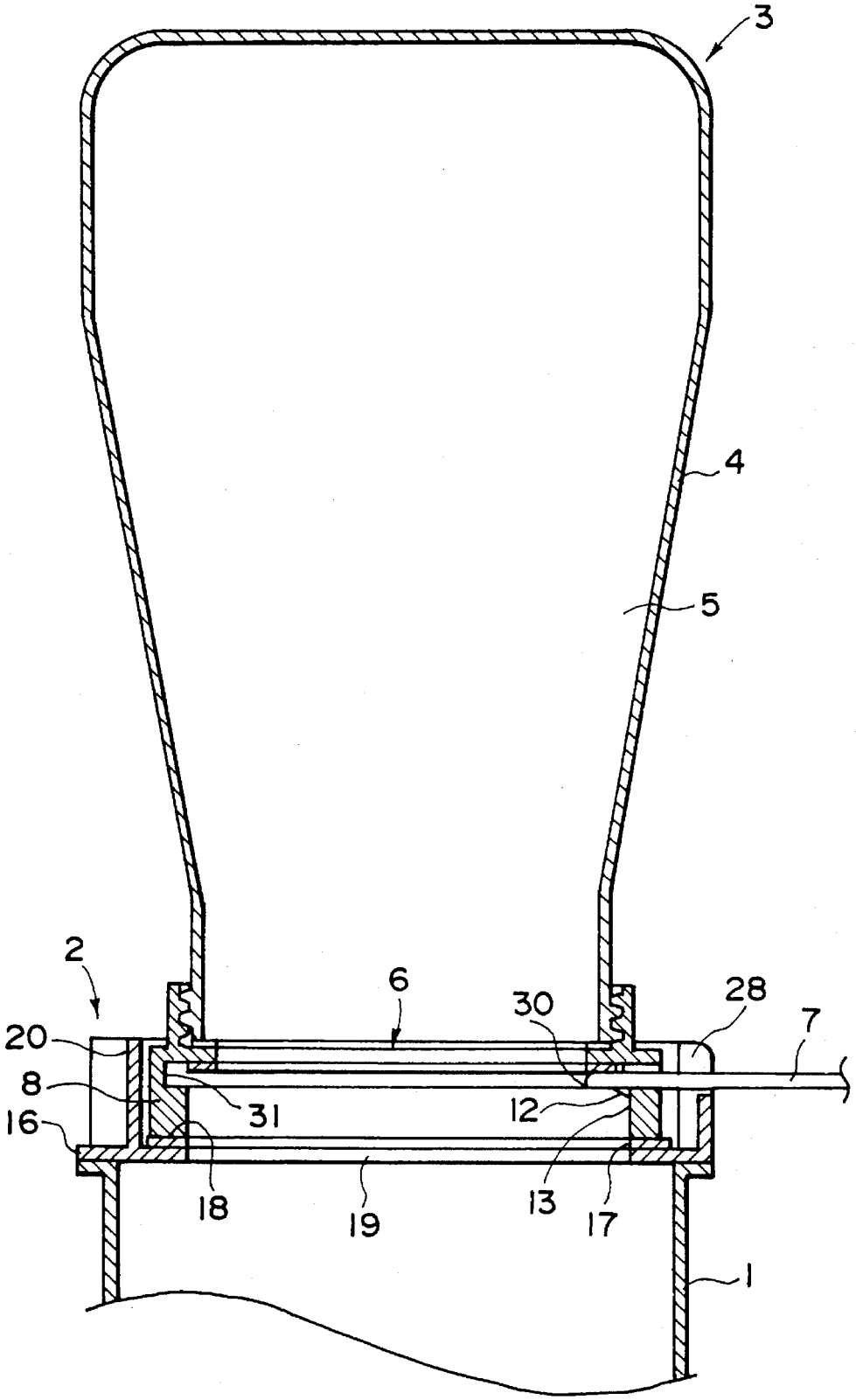
FIG. 6 is a sectional view taken along a line Y—Y in FIG. 3.

FIG. 3 shows a state in which the shutter plate is pulled to a position at which the stopper projection 12 is abutted to the wall surface 13 of the shutter support. FIG. 6 is a sectional view taken along a line Y—Y of FIG. 3.

In this state, the toner discharge opening 6 of the container body 4 of the toner cartridge is completely opened. The toner contained in the container body 4 falls by gravity into the hopper 1 with the opening action of the opening 6. When the opening 6 is completely opened, the toner in the container body 4 smoothly and quickly falls into the hopper 1.

When the toner supply operation from the toner cartridge 3 into the hopper 1 is completed, the operator pushes the grip 11 to push the shutter 7 as shown in FIG. 2. When the shutter plate 7 completely closes the toner discharge opening 6 (original position), the leading end 30 of the shutter plate 7 in the pushing direction B is contacted to the rear wall surface 31 of the shutter support 8, by which further pushing of the shutter 7*a* is prohibited (see FIG. 4).

When the shutter plate completely closes the toner discharge opening 6, the operator holds the container body 4 or the like by hand, and rotates the toner cartridge slidingly on the mount surface 18 in a direction opposite from the direction a as shown in FIG. 2, (b), by which the original mounting position of FIG. 1 is restored. By the rotation of the cartridge 3 in the direction b, the projection 23 of the cartridge 3 is disengaged from the mount 2, by which the operator can remove the toner cartridge 3 from the mount 2.

When the shutter plate 7 is in the process of pulling from the position shown in FIG. 2, or when it is in the process of pushing from the position shown in FIG. 3 to the position shown in FIG. 2, the toner cartridge 3 can not be removed from the mount, even if the operator erroneously tries to raise it. This is because the projection 23 of the toner cartridge is engaged into the recess 22 of the mount 2.

When the shutter plate 7 is in the process of being drawn from the position shown in FIG. 2 to the position shown in FIG. 3, or when it is in the process of being pushed from the position shown in FIG. 3 to the position shown in FIG. 2, in other words, when the toner discharge opening 6 of the container body 4 is not completely closed by the shutter plate 7, rotation of the toner cartridge 3 in the direction b is prohibited in this embodiment, even if the operator tries to rotate it in this direction.

Referring now to FIG. 3, this will be described in detail. The wall plate 20 of the cartridge mount 2 is provided with a limiting surface 28 facing to the pulling or pushing path of the shutter plate 7. When the shutter plate 7 is pulled out of the support 8 so that the toner discharge opening 6 is opened even slightly, the side surface 27*b* of the wide portion 7*b* of the shutter plate is opposed to the limiting surface 28 with or without small gap therebetween (FIG. 3).

If the operator tries to rotate the toner cartridge 3 in a direction b, erroneously, the side surface 27*b* of the wide portion 7*b* of the shutter plates abuts against the limiting surface 28, so that the rotation is stopped. Therefore, the projection 23 of the cartridge 3 does not disengage from the recess 22 of the mount 2. For this reason, the toner cartridge 3 is not removed from the mount 2.

When the shutter plate 7 takes the completely closed position for the toner discharge opening 6, the side surface 27*b* of the wide portion 7*b* of the shutter plate is not opposed to the limiting surface 28, but the side surface 27*a* of the narrow portion 7*a* of the shutter plate is faced to the regulating surface 28 (FIG. 2).

Therefore, in this state, when the toner cartridge 3 is rotated in the direction b, the side surface 27*a* of the narrow portion 7*a* does not abut the limiting surface 28, and therefore, a projection 23 of the toner cartridge 3 can be disengaged from the recess of the mount 2, and therefore, the toner cartridge 3 can be returned to the mounting and dismounting position shown in FIG. 1.

When the cartridge 3 returns to the position shown in FIG. 1 by rotation in the direction b, three parts of the side surface of the shutter support 8 of the cartridge are abutted to three parts of the guiding surface 21 of the cartridge mount, by which further rotation of the cartridge 3 in the direction b is prohibited, and therefore, the narrow portion 27*a* of the shutter plate 7 is not abutted to the limiting portion 28.

In any case, as described above, the toner cartridge 3 can not be returned to the cartridge mounting and dismounting position from the toner discharge position, as long as the toner discharge opening 6 is not completely closed by the shutter plate 7. Therefore, removal and the cartridge before the toner discharge opening is not completely closed is prevented with the result that toner powder remaining in the container body will not leak out and scatter.

In the foregoing example, the toner cartridge 3 is rotated slidingly in a direction a and b about an axis passing through a neighborhood of a center of the toner discharge opting 6, within an enclosure defined by wall 20 extended perendicularly thereto. With this structure, there is no need to provide a central rod, and therefore the structure is simple.

In the following example, a core rod is provided to improve the operativity in the rotation of the toner cartridge 3.

Referring to FIGS. 9, 10, 11 and 12, the same reference numerals as in the foregoing embodiment are assigned to members and portions having the corresponding functions, and the detailed descriptions thereof are omitted for simplicity.

Figure 10:
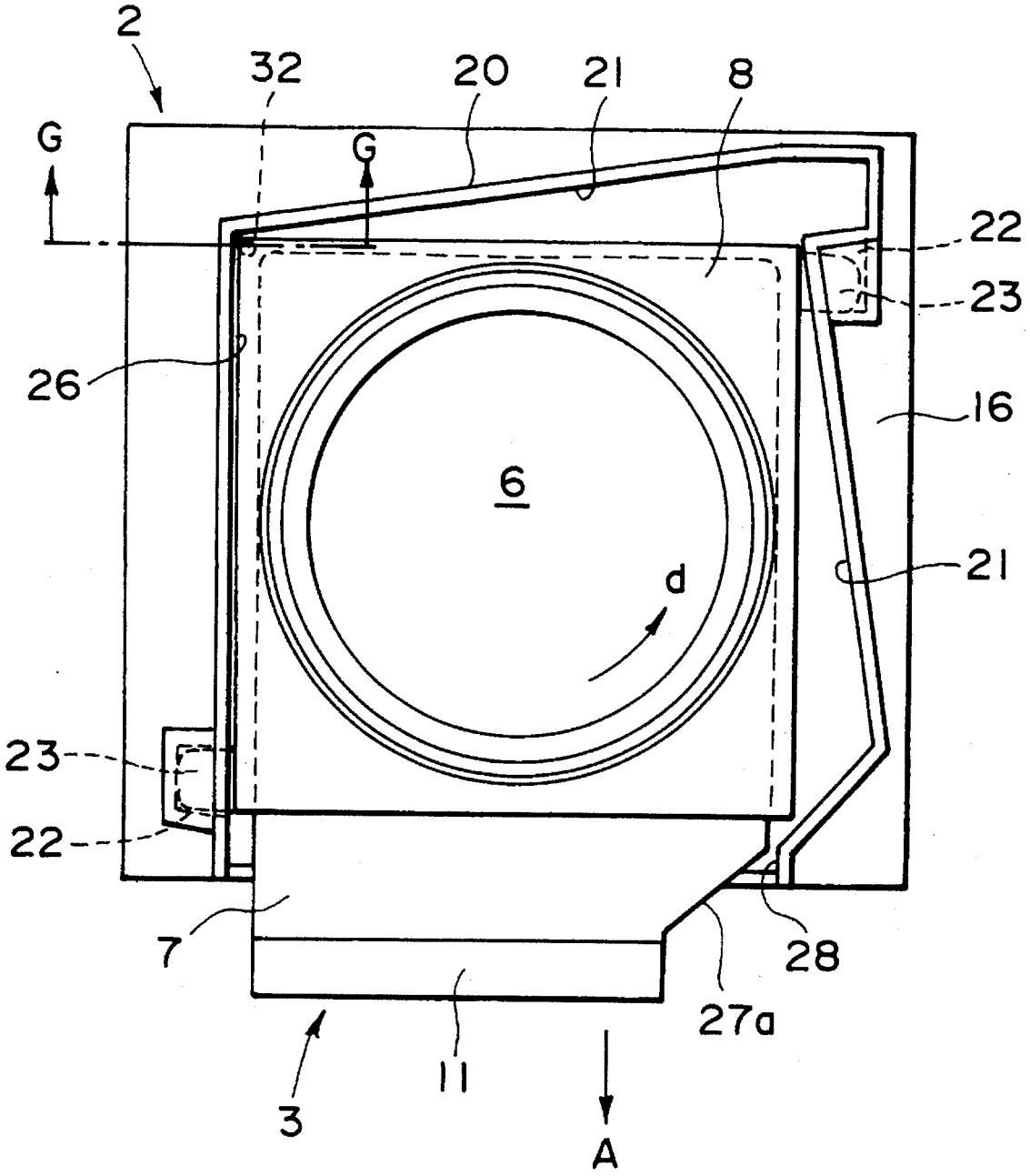
FIG. 10 is a top plan view of the same cartridge while the toner cartridge is in a toner discharge position.
Figure 12:
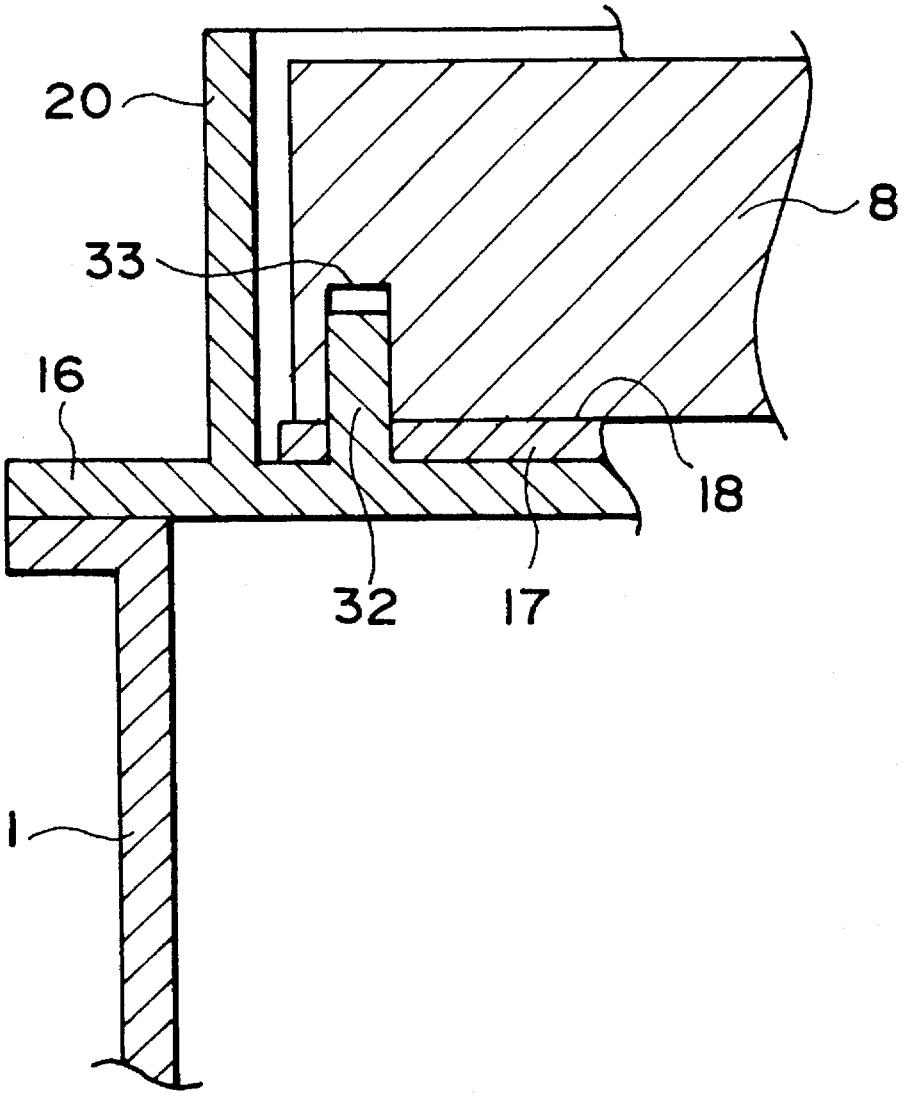
FIG. 12 is a sectional view taken along a line G—G of FIG. 10.

As shown in FIG. 12, which is a sectional view taken along a line G—G of FIG. 10, the base plate 17 of the cartridge mount 2 is provided with a core rod 32 extended substantially perpendicularly therefrom. A hole 33 formed adjacent a corner of the shutter support 8 of the cartridge 3 receives the core rod 32.

Figure 9:
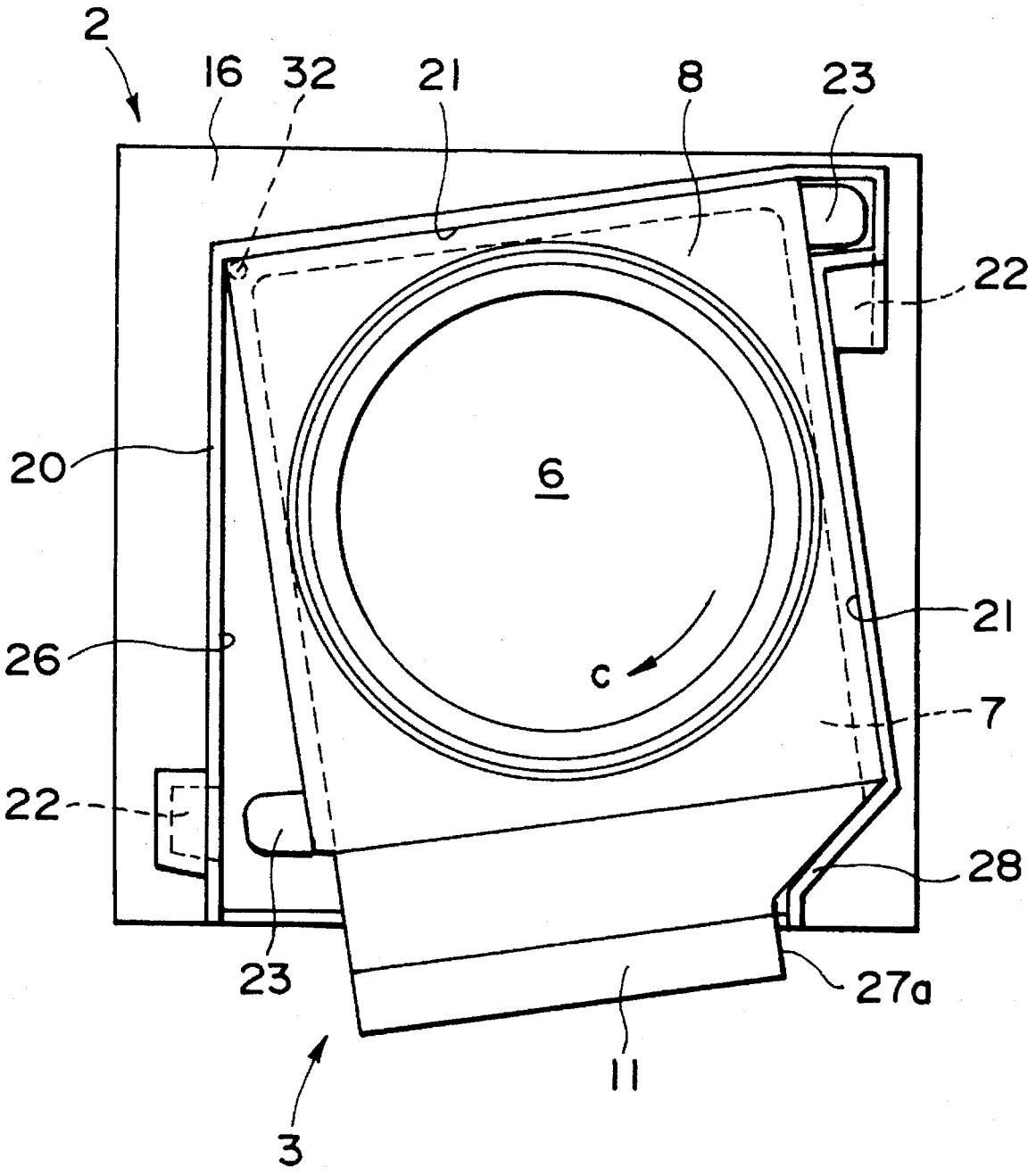
FIG. 9 is a top plan view of a toner cartridge according to another embodiment of the present invention which is in a removable position.
Figure 11:
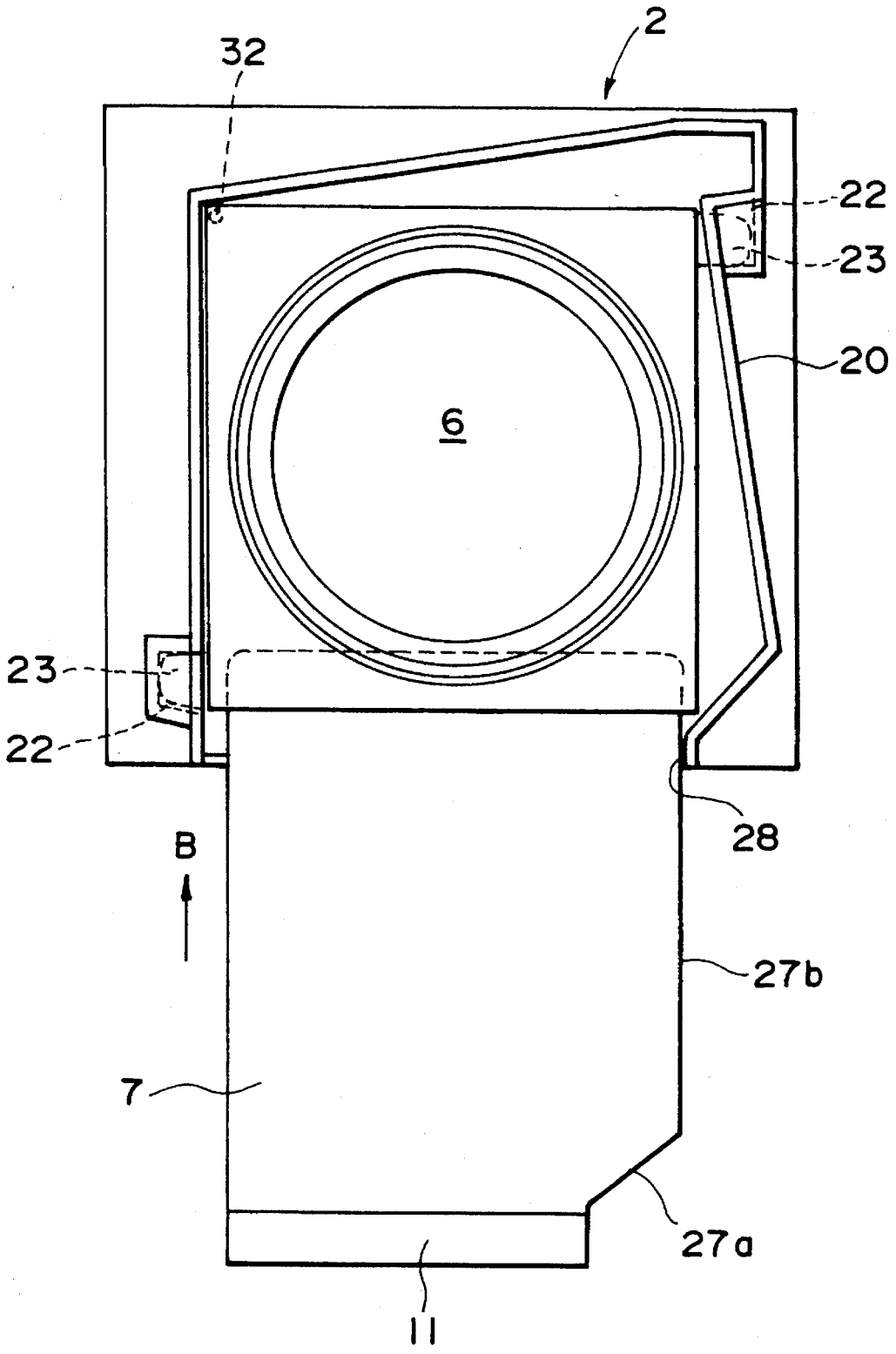
FIG. 11 is a top plan view of the same cartridge in which a shutter of the toner cartridge is completely opened, while the toner cartridge is placed in the toner discharging position.

Referring now to FIG. 9, the cartridge 3 rotates in a direction c about the core rod 32 from the position shown in FIG. 9 (mounting and dismounting position) on the mount surface 3, to the position shown in FIG. 10 (toner discharge position). Subsequently, the shutter plate 7 is pulled as shown in FIG. 11 to permit toner discharge. Then, the shutter plate 7 is pushed in, and the cartridge is rotated in a directional d which is opposite from the direction c about the core rod 32, sliding on the mount surface 3, by which it is returned from the position shown in FIG. 10 to the position shown in FIG. 9. In the position shown in FIG. 9, the cartridge 3 can be dismounted from the mount 2.

As long as the shutter plate 7 closes the toner discharge opening, the side surface **27*b* of the wide portion 7*b* of the shutter plate abut against the limiting surface 28 to prevent the rotation of the cartridge 3** from the toner discharging position to the cartridge mounting and dismounting position, similarly to the foregoing embodiment.

In the foregoing examples, when the toner cartridge 3 is moved from the mounting and dismounting position of FIGS. 1 or 9 to the toner discharging position of FIGS. 2 or 10, the toner discharging position of the toner cartridge 3 is reliably maintained by the engagement between the projection 23 and the recess 22. Therefore, the operation is easy and stabilized at the start of pulling the shutter plate out and at the end of pushing the shutter plate 7 in.

Figure 13:
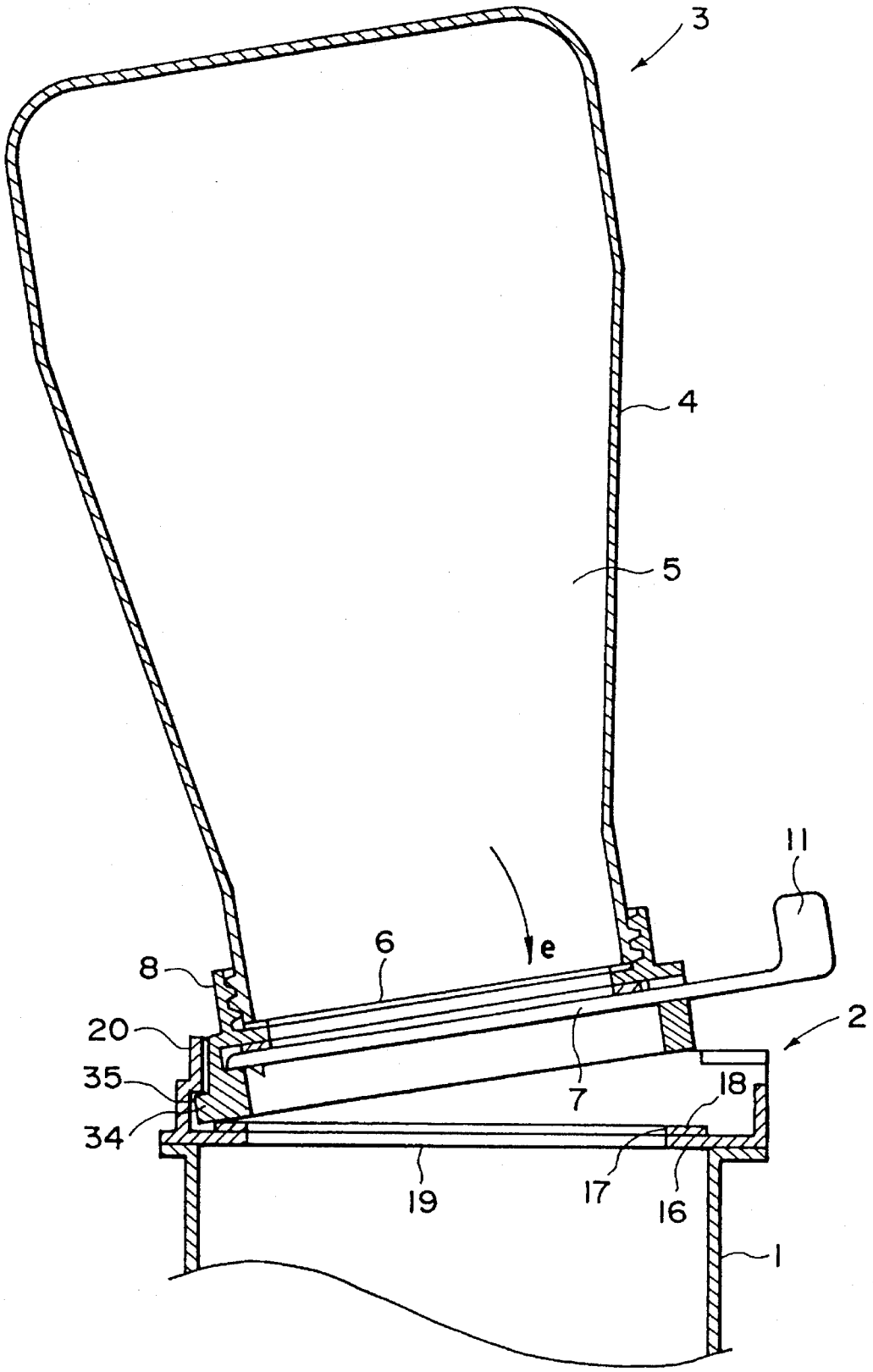
FIG. 13 is a sectional view of a toner cartridge in a removable position.

Referring now to FIG. 13, in the following embodiment, a pivot projection 34 is provided in the shutter support 8 of the toner cartridge 3 at an opposite side in the shutter plate pulling direction.

The operator holds the toner cartridge 3 and lowers it in an inclined direction. As shown in FIG. 13, the pivot projection 34 is engaged into the recess 35 of the wall plate 20 of the cartridge mount 2.

Figure 14:
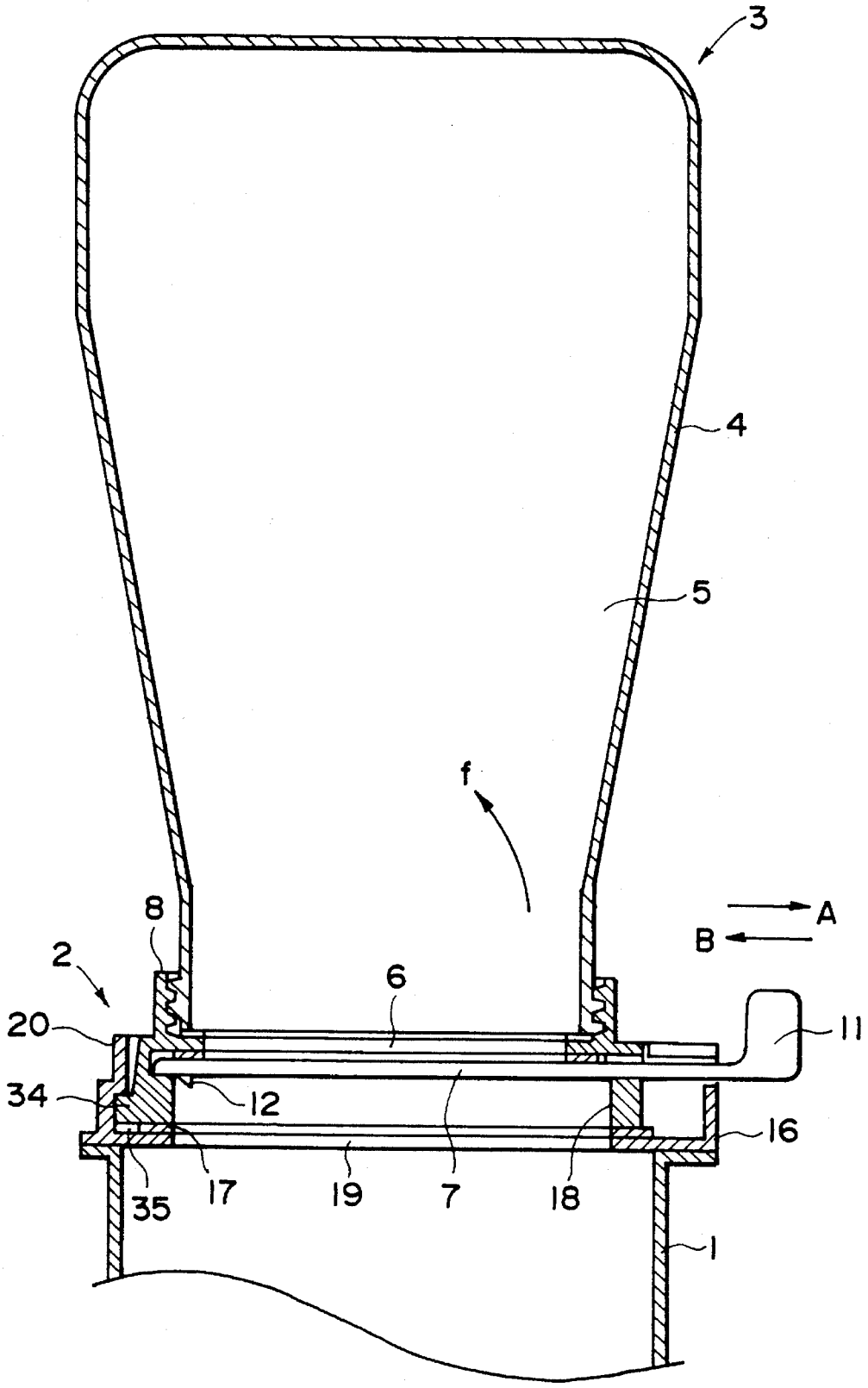
FIG. 14 is the same view when the toner cartridge is at the discharge position.

Subsequently, the operator rotates the cartridge 3 in a direction e about the pivot projection 34. As shown in FIG. 14, the bottom surface of the shutter support 8 is contacted to the top surface of the cartridge mount surface 18 (elastic sealing member 17) of the mount 2. The movement is guided by the sliding between the guiding surface 29 of the wall plate 20 and a side surface of the shutter support 8.

The cartridge position of FIG. 13 is a cartridge mounting and dismounting position, and the position shown in FIG. 14 is a toner discharging position.

Figure 15:
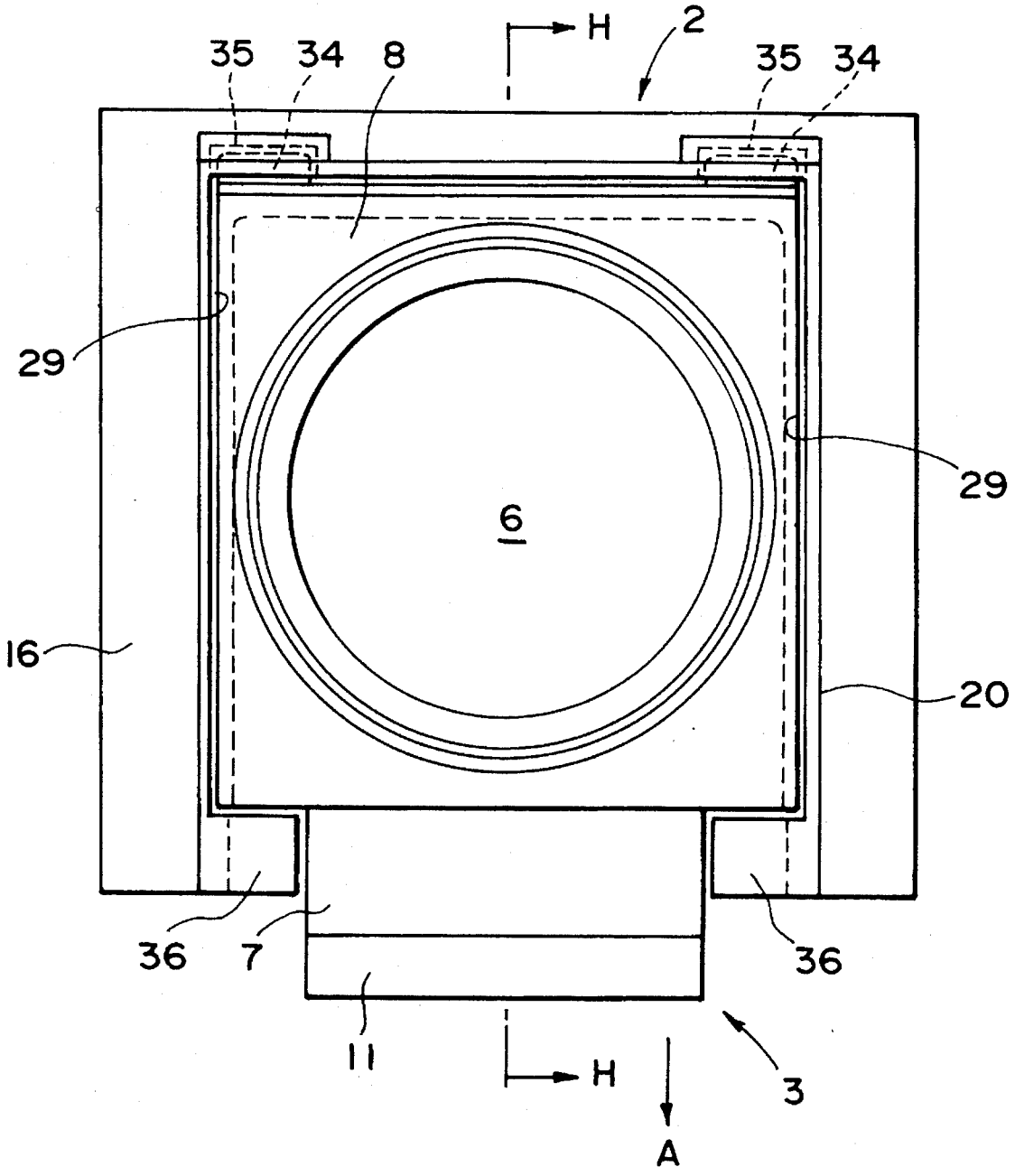
FIG. 15 is a top plan view of the toner cartridge of FIG. 14.
Figure 17:
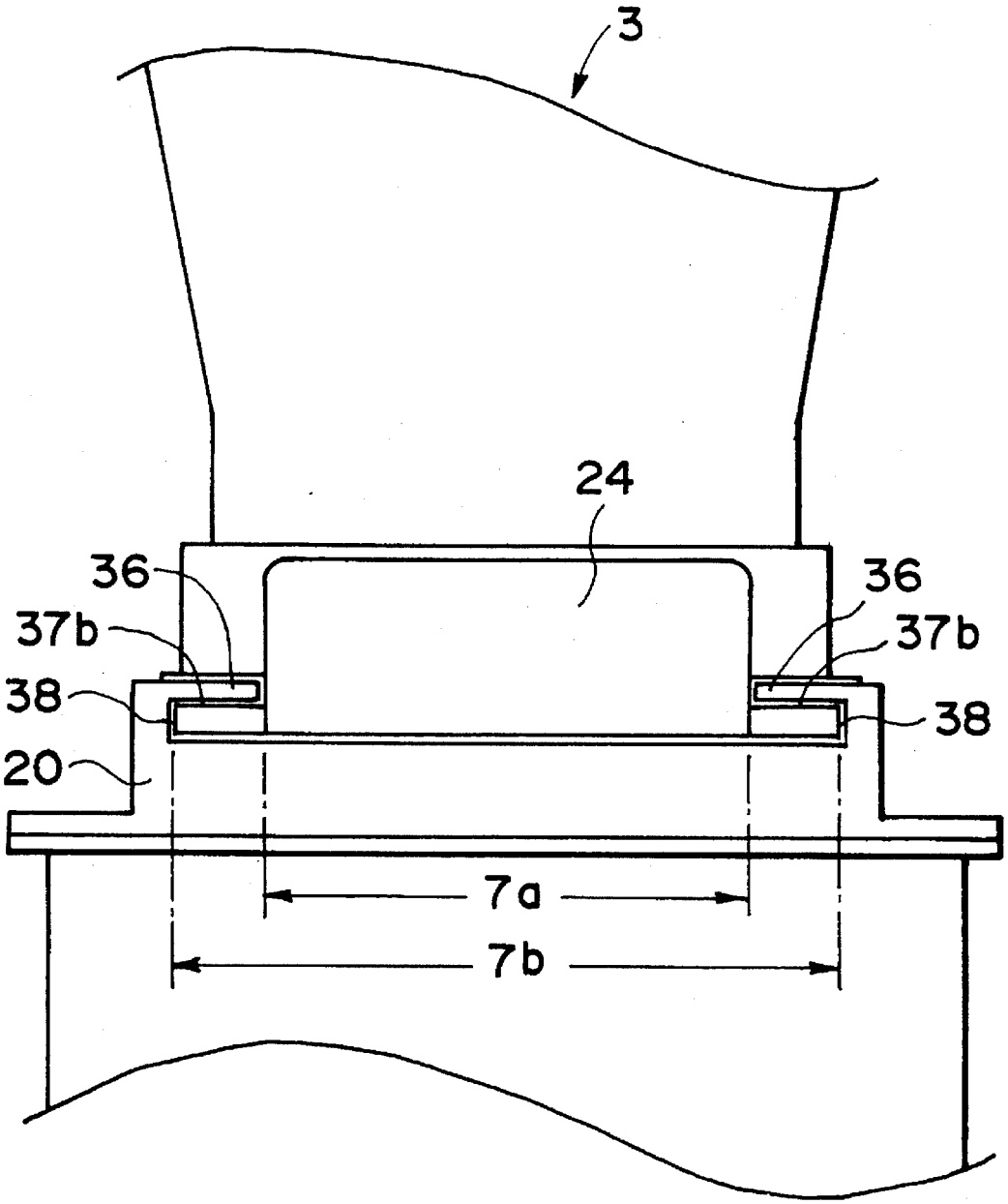
FIG. 17 is a front view of the cartridge of FIG. 14.

FIG. 15 is a top plan view in the state shown in FIG. 14, and FIG. 17 is a front view in the same state.

As will be understood from FIGS. 15 and 17, a pair of channel like projections 36 are provided with a space therebetween slightly larger than a width of a narrow portion **7*a* of the shutter plate 7, in a front portion of the wall plate 20 of the cartridge mount 2**.

When the cartridge 3 is rotated downwardly from the position shown in FIG. 13 to the position shown in FIG. 14, the narrow portion **7*a* of the shutter plate 7 passes between the projections 36, by which the cartridge 3 is closely contacted to the mount surface 18**.

Figure 16:
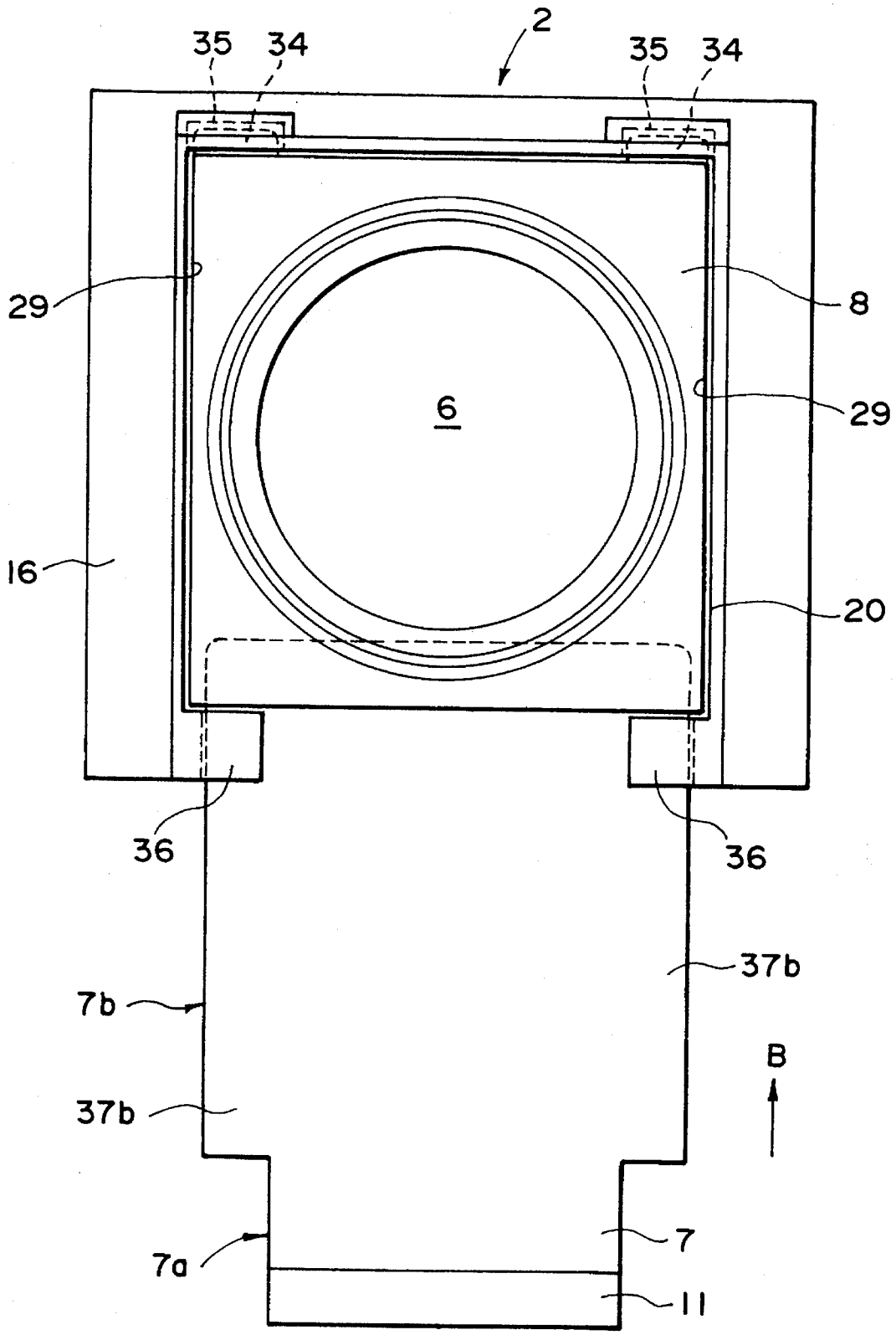
FIG. 16 is a top plan view of the toner cartridge in which the shutter is fully opened.

When the shutter plate is pulled in a direction A perpendicular to the direction of an arrow e to open the shutter discharge opening 6, side portions of the wide portion **7*b* of the shutter plate pass the gap of the recess at the lower part of the projection 36. Therefore, even if the toner cartridge 3 is attempted to be raised, the top surface 37*b* of the wide portion 7*b* is abutted to the bottom surface of the projection 36, and the pivot projection 34 is also engaged In the recess 35 of the mount 2, and therefore, raising of the toner cartridge 3 is prohibited. Therefore, the toner cartridge 3 is not removable from the mount 2 (see FIG. 16, which is a top plan view in which the shutter plate 7 has been pulled out to a position for completely open the toner discharge opening 6**).

In this manner, removal of the toner cartridge from the cartridge mount 2 is prohibited, except when the shutter plate 7 completely closes the toner discharging opening 6.

After the shutter plate 7 is pushed into a position for completely closing the toner discharge opening 6, the operator rotates upwardly about the pivot projection 34 under the guide by the guiding surface 29 in a direction f in FIG. 14 (opposite from the direction e), to the position shown in FIG. 13. Then, the cartridge 3 is raised upwardly in an inclined direction, by which the pivot projection 34 is disengaged from the recess 35, thus permitting removal of the cartridge from the mount 2.

In the embodiment of FIGS. 13–17, the mounting and dismounting direction of the toner cartridge at the position shown in FIG. 13, and the direction of the toner cartridge rotation between the position shown in FIG. 13 and the position shown in FIG. 14, are not deviated much, and the operation can be smoothly and continuously performed.

In this specification, the width of the shutter plate is a dimension of the shutter plate surface effective to close the toner discharge opening, measured in a direction perpendicular to the shutter plate pulling or pushing direction. A side surface of the shutter plate is an end surface of the shutter plate in the width direction. The top surface of the shutter plate is a surface of the shutter plate effective to close the shutter discharge opening.

As described in the foregoing, according to the present invention, erroneous operation of removing the toner cartridge from the mount before the toner discharge opening is completely closed, is prohibited with simple structure.

While the invention has been described with reference to the structures disclosed herein, it is not confined to the details set forth and this application is intended to cover such modifications or changes as may come within the purposes of the improvements or the scope of the following claims.

What is claimed is:

1. A toner cartridge mountable to a cartridge mount of a main assembly of an image forming apparatus comprising an electrostatic latent image bearing member, and a toner container for containing toner for developing an electrostatic latent image on said image bearing member, wherein said toner cartridge in said cartridge mount is disposable in a mounting position, where said cartridge can be mounted on or dismounted from said cartridge mount, and a toner supply position, where toner can be supplied from said toner cartridge into said toner container, and wherein when toner is to be supplied from said toner cartridge into said toner container, said toner cartridge is rotatable in a predetermined direction from the mounting position to the supply position, and when the toner cartridge is to be dismounted from the cartridge mount, the toner cartridge is rotatable in a direction opposite from the predetermined direction from the toner supply position to the mounting position, said toner cartridge comprising:

a container body for containing toner, said container body including a toner discharge opening for discharging toner from the container body;

a shutter for opening and shutting the discharge opening of said container body; and a shutter support for supporting said shutter for movement between a closed position for shutting the discharge opening, and an open position, away from the closed position, for opening the discharge opening of said container body, said shutter support including a projection at a corner portion of said shutter support, said projection being engageable with an engaging portion of said cartridge mount;

wherein when the toner cartridge is at the toner supply position, said projection is engaged with the engaging portion to prevent removal of said toner cartridge from the cartridge mount.

2. A cartridge according to claim 1, wherein said projection is provided at each of two diagonal corners of said shutter support.

3. A cartridge according to claim 1, wherein said toner cartridge is rotatable about an axis which is perpendicular to a mounting surface of the mount.

4. A cartridge according to claim 3, wherein a bottom surface of said shutter support is slidable on the mounting surface while said toner cartridge is rotatable in the cartridge mount, and three side walls of said shutter support are abuttable with stop walls of the cartridge mount to prevent further rotation of said toner cartridge in the cartridge mount.

5. A cartridge according to either claim 3 or 4, wherein said shutter is retractable in a direction perpendicular to a rotational direction.

6. A cartridge according to claim 5, wherein said shutter is provided with a stopper projection at a trailing end in the shutter retracting direction, and wherein when said shutter is retracted to an extent to completely open the discharge opening, said stopper projection abuts a front wall of said shutter support to prevent further retraction of said shutter.

7. A cartridge according to claim 6, wherein when said shutter is retracted at the toner supply position, said toner cartridge is prevented from movement from the toner discharge position to the mounting position to prevent removal of said toner cartridge from the mount.

8. A cartridge according to claim 1, wherein said shutter has a narrow portion and a wide portion which is in a front side of said narrow portion in a direction of movement of said shutter to the open position.

9. A cartridge according to claim 8, wherein the toner discharge opening of said toner cartridge is closed by the wide portion of said shutter, and wherein when the wide portion is slidably engaged with said shutter support, and the wide portion of said shutter closes the toner discharge opening of said toner cartridge, the narrow portion of said shutter projects away from said shutter support.

10. A cartridge according to either claim 8 or 9, wherein the cartridge mount is provided with a wall plate having a stopping surface facing a shutter movement path, wherein when said shutter is retracted from said shutter support, and the toner discharge opening is opened even slightly, movement of the toner cartridge is limited by abutment between a side surface of the wide portion of said shutter and the stopping surface, so that removal of the toner cartridge from the cartridge mount is prevented.

11. A toner supply apparatus comprising:

a cartridge mount having a mounting position, where a toner cartridge can be mounted on or dismounted from said cartridge mount and a toner supply position, where toner can be supplied from said toner cartridge into a toner container, wherein when toner is to be supplied into said toner container, said toner cartridge is rotated in a predetermined direction from the mounting position to the supply position, and when the toner cartridge is to be dismounted from the cartridge mount, the toner cartridge is rotated in a direction opposite from the predetermined direction from the toner supply position to the mounting position;

a container body for containing toner said container body including a toner discharge opening for discharging toner from the container body;

a shutter, operable in the toner discharge position, for shutting and opening the discharge opening of said container body; and a shutter support for movably supporting said shutter, said shutter support including a projection at a corner portion of said shutter support;

wherein when the toner cartridge is at the toner supply position, said projection is engaged with an engaging portion of said cartridge mount to prevent removal of said toner cartridge from the mount.

12. An apparatus according to claim 11, wherein said cartridge mount has a surface for supporting said toner cartridge, wherein said toner cartridge slides on the supporting surface during rotation between the mounting position and the toner discharge position, and wherein said cartridge mount has a recess in a wall of said mount, and said engaging portion is engageable with the recess when said cartridge is rotated from the mounting position to the toner discharge position.

13. An apparatus according to claim 11, wherein said projection is provided at each of two diagonal corners of said support.

14. A toner supply apparatus comprising:

a cartridge mount having a mounting position, where a toner cartridge can be mounted on or dismounted from said cartridge mount, and a toner supply position, where toner can be supplied from said toner cartridge to a toner container, wherein when toner is to be supplied into said toner container, said toner cartridge is rotated in a predetermined direction from the mounting position to the supply position, and when the toner cartridge is to be dismounted from the cartridge mount, the toner cartridge is rotated in a direction opposite from the predetermined direction from the toner supply position to the mounting position;

a container body for containing toner, said container body including a toner discharge opening for discharging toner from the container body;

a shutter, movable in a direction crossing the predetermined direction in the toner discharge position, for shutting and opening the discharge opening of said container body, said shutter having a narrow portion and a wide portion, wherein the narrow portion is in front of the wide portion in a shutter opening direction; and a stopper provided in said cartridge mount, wherein when said shutter opens the toner discharge opening of said container body in the toner discharge position, the wide portion if said shutter abuts said stopper to prevent rotation of said toner cartridge in a direction opposite from the predetermined direction, and when said shutter shuts the toner discharge opening of said container body in the toner discharge position, the narrow portion of said shutter faces said stopper to permit rotation of said toner cartridge in the direction opposite from the predetermined direction.

15. An apparatus according to claim 14, wherein said cartridge mount has a surface for supporting said toner cartridge, wherein said toner cartridge slides on the supporting surface during rotation between the mounting position and the toner discharge position, and wherein said cartridge mount has a stop portion to be engaged, an engaging portion of said toner cartridge being engageable with the stop portion when said toner cartridge rotates in the predetermined direction to prevent removal of said toner cartridge, and wherein said stopper abuts a side surface of the wide portion of said shutter.

16. An apparatus according to claim 15, wherein said cartridge mount has a guiding surface for guiding mounting or dismounting of said toner cartridge relative to said cartridge mount in sliding contact with said toner cartridge, said stopper preventing rotation of said toner cartridge from the toner discharging position in the predetermined direction.

17. An apparatus according to claim 14, wherein said cartridge mount is provided with a stop portion engageable with an engaging portion of said toner cartridge, wherein said toner cartridge is rotated upwardly and downwardly between the mounting position and the toner discharge position about an engagement position between said engaging portion and the stop portion, and said stopper is abutted to a top surface of the wide portion of said shutter.

18. A toner cartridge mountable to a cartridge mount of a main assembly of an image forming apparatus comprising an electrostatic latent image bearing member, and a toner container for containing toner for developing an electrostatic latent image on said image bearing member, wherein said toner cartridge in said cartridge mount is disposable in a mounting position, where said toner cartridge can be mounted on or dismounted from said cartridge mount, and a toner supply position, where toner can be supplied from said toner cartridge into said toner container, and wherein when toner is to be supplied into said toner container, said toner cartridge is rotated in a predetermined direction from the mounting position to the supply position, and when the toner cartridge is to be dismounted from the cartridge mount, the toner cartridge is rotated in a direction opposite from the predetermined direction from the toner supply position to the mounting position, said toner cartridge comprising:

a container body for containing toner, said container body including a toner discharge opening for discharging toner from the container body; and a shutter, movable in a direction crossing the predetermined direction in the toner discharge position, for shutting and opening the discharge opening of said container body, said shutter having a narrow portion and a wide portion, wherein the narrow portion is in front of the wide portion in a shutter opening direction;

wherein when said shutter opens the toner discharge opening of said container body in the toner discharge position, the wide portion of said shutter abuts a stopper to prevent rotation of said toner cartridge in a direction opposite from the predetermined direction, and when said shutter shuts the toner discharge opening of said container body in the toner discharge position, the narrow portion of said shutter faces the stopper to permit rotation of said toner cartridge in the opposite direction.

19. An apparatus according to claim 18, wherein said toner cartridge has an engaging portion, and is rotatable in sliding contact with a surface of the cartridge mount for supporting said toner cartridge during rotation between the mounting position and the toner discharge position, and wherein said engaging portion engages a stop portion of the cartridge mount when said toner cartridge rotates in the predetermined direction to prevent removal of said toner cartridge, and wherein said stopper abuts a side surface of the wide portion.

20. An apparatus according to claim 19, wherein said toner cartridge has a sliding portion for guiding mounting or dismounting of said toner cartridge relative to the cartridge mount in sliding contact with a guiding surface of the cartridge mount, and an abutment portion for preventing further rotation of said toner cartridge in the predetermined direction from the toner discharge position by abutment to a stop of the cartridge mount.

21. An apparatus according to claim 18, wherein said toner cartridge has an engaging portion engageable with a stop portion to be engaged on the cartridge mount, wherein said toner cartridge is rotatable upwardly and downwardly between the mounting position and the toner discharge position about an engagement position between said engaging portion and the stop portion, and said stopper is abutted to a top surface of the wide portion of said shutter.

22. A cartridge according to either claim 1 or 2, wherein said shutter is provided with a stopper projection at a trailing end in a shutter retracting direction, and when said shutter is retracted to an extent to completely open the discharge opening, said stopper projection abuts a front wall of said shutter support to prevent further retraction of said shutter.

23. A cartridge according to either claim 1 or 2, wherein when said shutter is retracted at the toner supply position, said toner cartridge is prevented from movement from the toner discharge position to the mounting position to prevent removal of said toner cartridge from the mount.

24. A toner supply mechanism comprising:

a toner storage unit for storing toner;

a toner container for containing toner to be supplied to said toner storage unit, said toner container including a toner containing portion for containing the toner, said toner containing portion having a toner discharge opening and closing means for opening and closing the discharge opening;

a container mounting portion having a receiving opening for receiving toner from said toner container to supply toner into said toner storage unit, said container mounting portion receivably mounting said toner container with the discharging opening facing downward toward said receiving opening;

wherein when said toner container is mounted on said container mounting portion said toner container is rotatable about an axis substantially perpendicular to a mounting surface of said container mounting portion between a first angular position for mounting and dismounting said toner container and a second angular position for supplying toner to said toner storage unit; and wherein said container mounting portion has a dismounting preventing portion engageable with said toner container at the second angular position to prevent dismounting of said toner container.

25. A mechanism according to claim 24, wherein said container mounting portion has an opening preventing portion for preventing the discharge opening of said toner container from being opened at the first angular position.

26. A mechanism according to claim 25, wherein said closing means has a shutter for closing and opening the discharge opening, and said opening preventing portion prevents motion of said shutter to prevent the discharge opening of said toner container from opening.

27. A mechanism according to claim 26, wherein said container mounting portion includes a rotation preventing portion for preventing rotation of said toner container from the second angular position to the first angular position, by engagement with said shutter, when said toner container is at the second angular position and said shutter is at an open position.

28. A mechanism according to claim 24, wherein said container mounting portion has a guiding surface for guiding movement of said toner container in a direction of the axis.

29. A mechanism according to claim 24, wherein said toner container includes a projection engageable with a recess of said dismounting preventing portion by rotation of said toner container to the second angular position, thereby to prevent dismounting of said toner container.

30. A mechanism according to claim 29, wherein said closing means includes a shutter for opening and closing the discharge opening, and a shutter supporting member for supporting said shutter, and wherein said projection is mounted on said shutter supporting member.

31. A mechanism according to claim 30, wherein said shutter supporting member is substantially rectangular, and the projection is provided adjacent a corner of said shutter supporting member.

32. A mechanism according to claim 31, wherein said projection is provided at each of two diametrically opposite positions of said shutter supporting member.

* * * * *

UNITED STATES PATENT AND TRADEMARK OFFICE

CERTIFICATE OF CORRECTION

PATENT NO. : 5,593,068
DATED : January 14, 1997
INVENTOR(S) : Kunihiko Kitayama, et al.

It is certified that error appears in the above-identified patent and that said Letters Patent is hereby corrected as shown below:

Title Page

Under item [56], "References Cited"

OTHER PUBLICATIONS:

Insert --European Search Report dated March 4, 1996.--.

IN THE DISCLOSURE

Column 1:
Line 12, "usable with" should read --using--;
Line 21, "Is" should read --is--; and
Line 35, "is" should read --in--.

Column 2:
Line 51, "limit" should read --unit--.

Column 3:
Line 9, "dot, dash" should read --dot-dash--.

Column 4:
Line 8, "Figures." should read --figures.--; and
Line 60, "are" should read --is--.

Column 6:
Line 12, "without" should read --without a--;
Line 45, "and" should read --of--; and
Line 50, "in a direction" should read --in directions--.

UNITED STATES PATENT AND TRADEMARK OFFICE

CERTIFICATE OF CORRECTION

PATENT NO. : 5,593,068
DATED : January 14, 1997
INVENTOR(S) : Kunihiko Kitayama, et al.

It is certified that error appears in the above-identified patent and that said Letters Patent is hereby corrected as shown below:

Column 7:
Line 17, "abut" should read --abuts--.

Column 8:
Line 1, "In" should read --in--;
Line 5, "open" should read --opening--; and
Line 37, "with" should read --with this--.

Column 10:
Line 5, "toner said" should read --toner, said--; and
Line 58, "if" should read --of--.

Signed and Sealed this

Seventeenth Day of July, 2001

Nicholas P. Godici

*Attest:*

*Attesting Officer*

NICHOLAS P. GODICI
*Acting Director of the United States Patent and Trademark Office*